US006231039B1

(12) United States Patent
Chung

(10) Patent No.: US 6,231,039 B1
(45) Date of Patent: May 15, 2001

(54) SHEET POST-PROCESSING APPARATUS

(75) Inventor: Jae-Heon Chung, Kyoungki-do (KR)

(73) Assignee: Sindoricoh Co., Ltd., Seoul (KR)

( * ) Notice: Subject to any disclaimer, the term of this patent is extended or adjusted under 35 U.S.C. 154(b) by 0 days.

(21) Appl. No.: 09/397,522

(22) Filed: Sep. 17, 1999

(30) Foreign Application Priority Data

Sep. 17, 1998 (KR) ..... 98-38424

(51) Int. Cl.[7] ..... B65H 29/26

(52) U.S. Cl. ..... 270/58.01; 270/58.13; 270/58.18; 270/58.12; 271/213; 271/217; 414/794.2; 414/791.2

(58) Field of Search ..... 270/58.12, 58.13, 270/58.18, 58.07, 58.08, 58.09, 58.28, 58.01; 414/791.2, 794.2; 271/293, 213, 217

(56) References Cited

U.S. PATENT DOCUMENTS

| | | | | |
|---|---|---|---|---|
| 3,410,424 | * | 11/1968 | Rooney, Jr. | 414/790.4 |
| 4,473,425 | * | 9/1984 | Baughman et al. | 270/58.08 X |
| 4,611,741 | * | 9/1986 | Wilson | 270/58.08 X |
| 5,021,837 | | 6/1991 | Uto et al. | 399/405 |
| 5,285,249 | * | 2/1994 | Mahoney | 270/58.07 X |
| 5,385,340 | | 1/1995 | Hiroi et al. | 270/58.13 |
| 5,447,298 | | 9/1995 | Watanabe et al. | 270/58.11 |
| 5,803,706 | * | 9/1998 | Achelphohl | 414/790.4 |
| 5,961,274 | * | 10/1999 | Bors | 414/791 |
| 6,106,219 | * | 8/2000 | Newsome et al. | 414/794.2 X |

FOREIGN PATENT DOCUMENTS

| | | | |
|---|---|---|---|
| 403111372A | * | 5/1991 | (JP) . |
| 8-9451 | | 1/1996 | (JP) . |

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

A sheet post-processing apparatus comprises a conveyer for conveying the sheets discharged from the image forming system; a conveying device for conveying the sheets discharged from the image forming system; a pair of upper trays for accommodating the sheets conveyed by the conveying devices, and being horizontally moved in order to align the sheets accommodated therein and fall down the aligned sheets; a pair of upper tray driving devices for providing a driving force to the upper trays; a transmission unit for transmitting the driving force of the upper tray driving device to the upper trays; a lower tray for loading the sheets fallen from the upper trays; and a lower tray driving device for moving the lower tray in upper and lower directions in order to retain distance between the upper trays and the lower tray within a predetermined range. Thus, the sheet post-processing apparatus can accommodate variant size sheets by mechanism consisting of simple and cheap elements.

9 Claims, 8 Drawing Sheets

SHEET POST-PROCESSING APPARATUS

BACKGROUND OF THE INVENTION

1. Field of the Invention

The present invention relates to a sheet post-processing apparautus adjacent to a sheet discharging section of an image forming system such as a copier, a printer, a facsimile and so on. More particularly, it relates to a sheet post-processing apparatus capable of performing post-process such as a stapling or a punching to sheets on which images are formed by the image forming system.

2. Description of Related Art

Recently, the image forming system is developed from analogue type into digital type. The digital image forming appartus can perform one or more function(s) of copy function, print function, facsimile function and selectively discharge the sheets on which images are formed.

That is, since the digital image forming system can store image data to be copied or printed, the image forming system can print the images on the sheets and discharge the sheets on which the images are formed, according to sequency which user wants. Therefore, a sheet post-processing apparatus of the analogue image forming system requires a plurality of accommodation trays for sorting and accommodating the sheets, but a sheet post-processing apparatus of the digital image forming system, without a plurality of accommodation trays, can sort and accommodate the sheets by only one accommodation tray for temporarily accommodating the sheets until sheets are completely discharged from the image forming system.

As an embodiment of the new sheet post-processing apparatus, when the digital image forming system copies a manuscript consisting of a plurality of sheets to make a plurality of duplicates, the image forming system repeatedly performs operation which prints and discharges the manuscript successively until all the sheets are accommodated into the accommodation tray. Thereafter, the sheet post-processing apparatus accommodates the sheets into a tray which has a stacker function. In this case, if necessary, the sheet post-processing apparatus can staples(or punches) the discharged sheets before accommodating the sheets into the stacker.

Further, the accommodation tray for temporarily accommodating the sheets has an aligning function to align the sheets accommodated therein and an offset function to accommodate bundles of sheets to be post-processed in zigzags.

The sheet post-processing apparatus of the digital image forming system is disclosed in U.S. Pat. No. 5,385,340 and U.S. Pat. No. 5,021,837, and the sheet post-processing apparatuses are briefly explained in the following, referring to FIGS. 1 and 2.

As shown in FIG. 1, the conventional sheet post-processing apparatus is adjacent to a discharging section 2 of the image forming system 1 and is provided with a copy sheets discharged from the discharging section 2. The copy sheets transferred to the conventional sheet post-processing apparatus are discharged from a sheet oulet 9 by a conveyer 4 and is accommodated into an aligning tray 5 slantedly disposed. In this case, an end of each of the copy sheets is supported by a pusher 8 disposed at lower portion of the aligning tray 5 so that the copy sheets may be aligned. Further, in order to accurately align the copy sheets, the conventional sheet post-processing apparatus has a roller 7 for moving the copy sheets accommodated into the aligning tray 5 toward pusher 8.

When the process as above-mentioned is repeated and the sheets are completely discharged from the image forming system, a solenoid 5*a* connected to the aligning tray 5 operates to align a side of each of the sheets accommodated into the aligning tray 5. Then, the conventional sheet post-processing apparatus performs a post-process by a punch (not shown) or a stapler 10 to the aligned sheets. Thereafter, the pusher 8 supporting the end of each of the sheets is forwardly moved by a motor 8*a* so that the post-processed sheets are accommodated into an accommodation tray 6.

Further, the conventional sheet post-processing apparatus has a motor 6*a* capable of vertically moving the accommodation tray 6. The motor 6*a* moves the accommodation tray 6 to the position suitable for accommodation of the sheets. That is, when a bundle of sheets is accommodated into the accommodation tray 6, the motor 6*a* moves the accommodation tray 6 downward by a predetermined distance so that upper end of the accommodation tray 6 is positioned in place capable of accommodating the next bundle of sheets.

Furthermore, the conventional sheet post-processing apparatus has a motor 6*b* for horizontally moving the accommodation tray 6 in order to offset the sheets. As shown in FIG. 2, when a bundle of sheets is completely accommodated into the accommodation tray 6, the motor 6*b* moves the accommodation tray 6 horizontally. At this time, when the next bundle of sheets is accommodated into the accommodation tray 6, the previous bundle of sheets and the next bundle of sheets are positioned in zigzags. Therefore, when a plurality of bundles of sheets are accommodated into the accommodation tray 6, it may be prevented that staples imbeded into the bundles are stacked and a portion of the sheets accommodated into the accommodation tray is higher than the other portions.

However, since the conventional sheet post-processing apparatus aligns a side of each of the sheets accommodated into the aligning tray by the solenoid, there is a problem that sizes of the sheets used for the apparatus should be uniform.

Further, when a plurality of sheets are accommodated into the accommodation tray, since a large of load is applied to the motor for horizontally moving the accommodation tray, expensive motor capable of generating great driving force should be used for the apparatus in order to bear the load.

Furthermore, since the conventional apparatus has a plurality of elements for moving the sheets(that is, a pusher, a motor to operate the pusher and so on), the structure is complex.

SUMMARY OF THE INVENTION

It is, therefore, an object of the present invention to provide a sheet post-processing apparatus capable of accommodating variant size sheets by mechanism consisting of simple and cheap elements.

In order to accomplish the above object, the sheet post-processing apparatus, according to the present invention, comprises: a conveyer for conveying the sheets discharged from an image forming system; a conveying device for conveying the sheets discharged from the image forming system; a pair of upper trays for accommodating the sheets conveyed by the conveying devices, and being horizontally moved in order to align the sheets accommodated therein and fall down the aligned sheets; a pair of upper tray driving devices for providing a driving force to the upper trays; a transmission unit for transmitting the driving force of the upper tray driving device to the upper trays; a lower tray for loading the sheets fallen from the upper trays; and a lower tray driving device for moving the lower tray in upper and lower directions in order to retain distance between the upper trays and the lower tray within a predetermined range.

In this case, the transmission unit of the present invention comprises a base plate having a first and a second supporting bars, a plurality of erect portions formed on the each upper tray member and having a through hole for passing the supporting bar, a plurality of belts to be moved by the driving force provided from the motors, a plurality of abutments fixed to the upper tray members and the belts so that the upper tray members are moved together the belts.

BRIEF DESCRIPTION OF THE ATTACHED DRAWINGS

Other features in structure, operation and advantages of the present invention will become more apparent to those skilled in the art from the following descriptions when in conjunction with the accompanying drawings, in which.

DETAILED DESCRIPTIONS OF A PREFERRED EMBODIMENT

Hereinafter, the embodiment according to the present invention will be described in detail, referring to the accompanying FIGS. 3 to 13.

Figure 1:
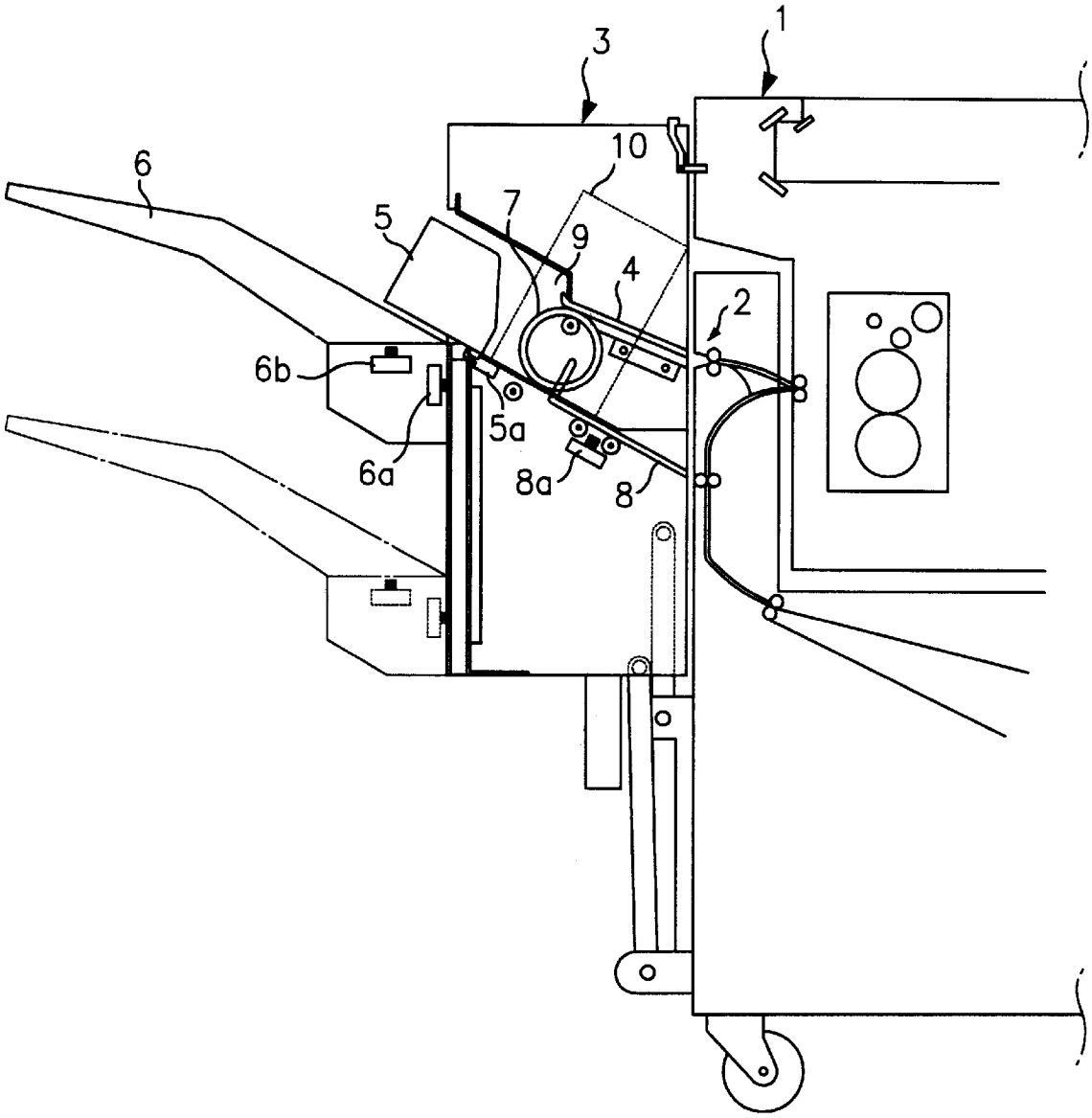
FIG. 1 is a side view showing a structure of a sheet post-processing apparatus of the prior art.
Figure 2:
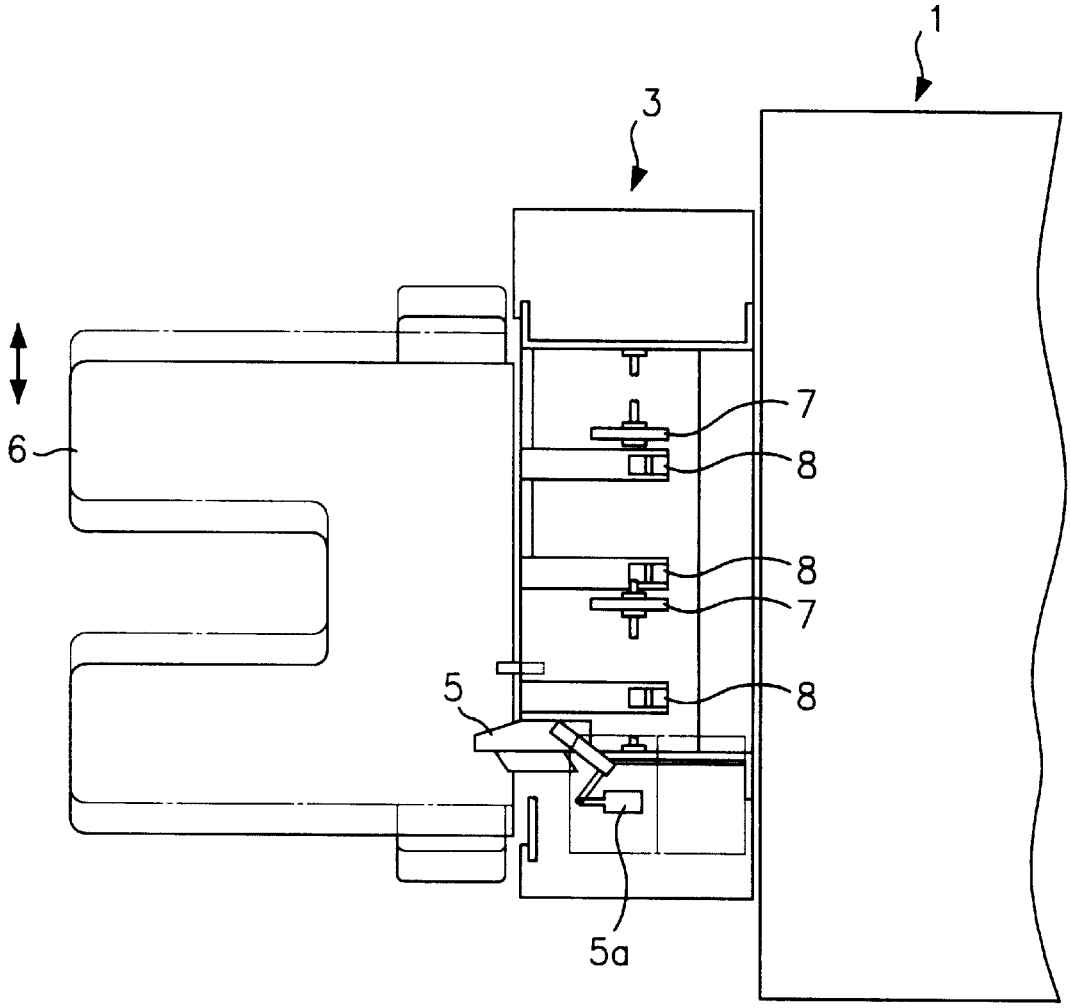
FIG. 2 shows operation of an accommodation tray of the sheet post-processing apparatus of the prior art.
Figure 3:
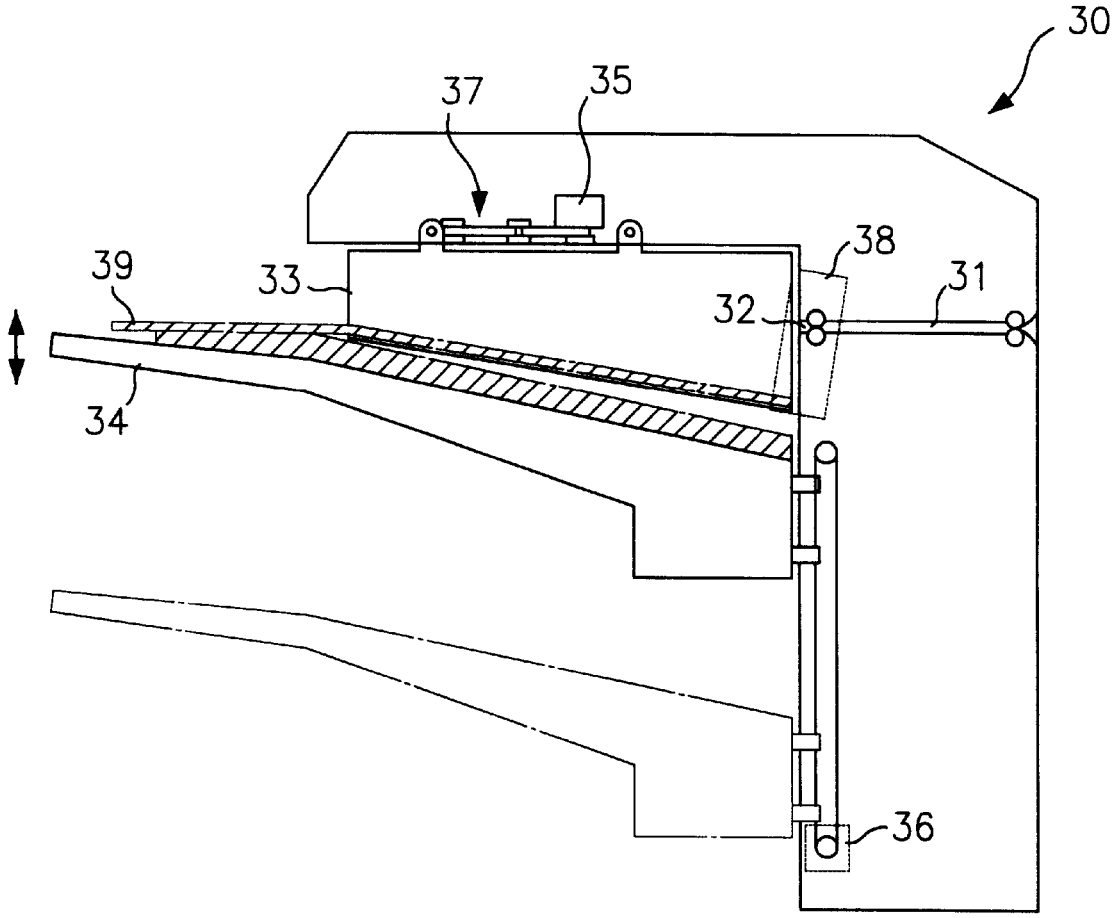
FIG. 3 is a side view showing a structure of a sheet post-processing apparatus according to the present invention.
Figure 4:
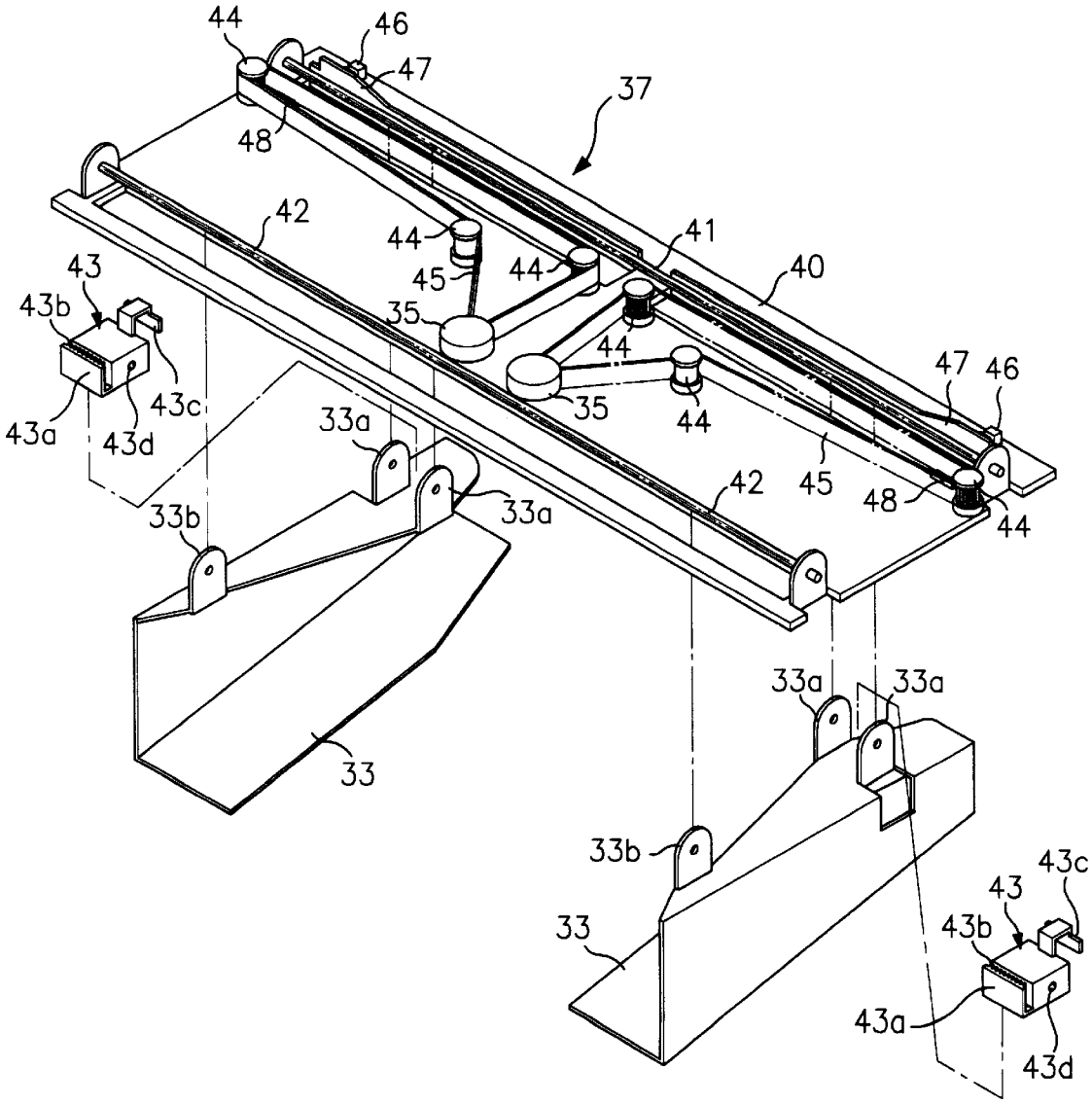
FIG. 4 is a perspective view showing a disassembly of an upper tray driving portion of the sheet post-processing apparatus according to the present invention.
Figure 5:
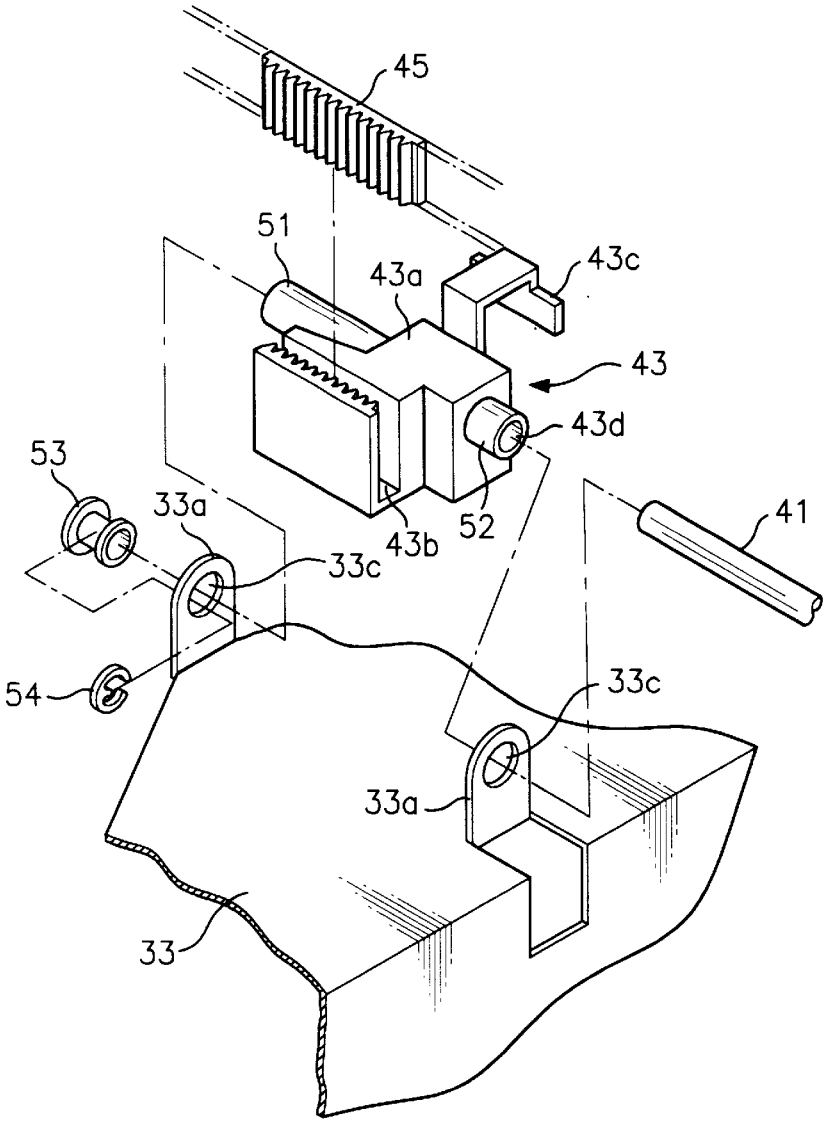
FIG. 5 is a perspective view showing a disassembly of an abutment of the sheet post-processing apparatus according to the present invention.
Figure 6:
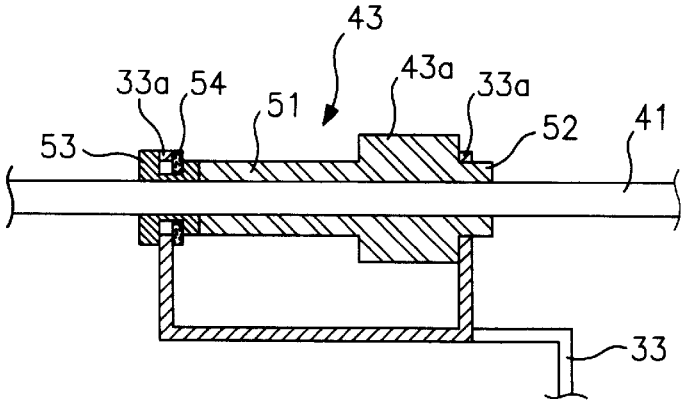
FIG. 6 is a cross-sectional view showing an assembly of the FIG. 5.
Figure 7:
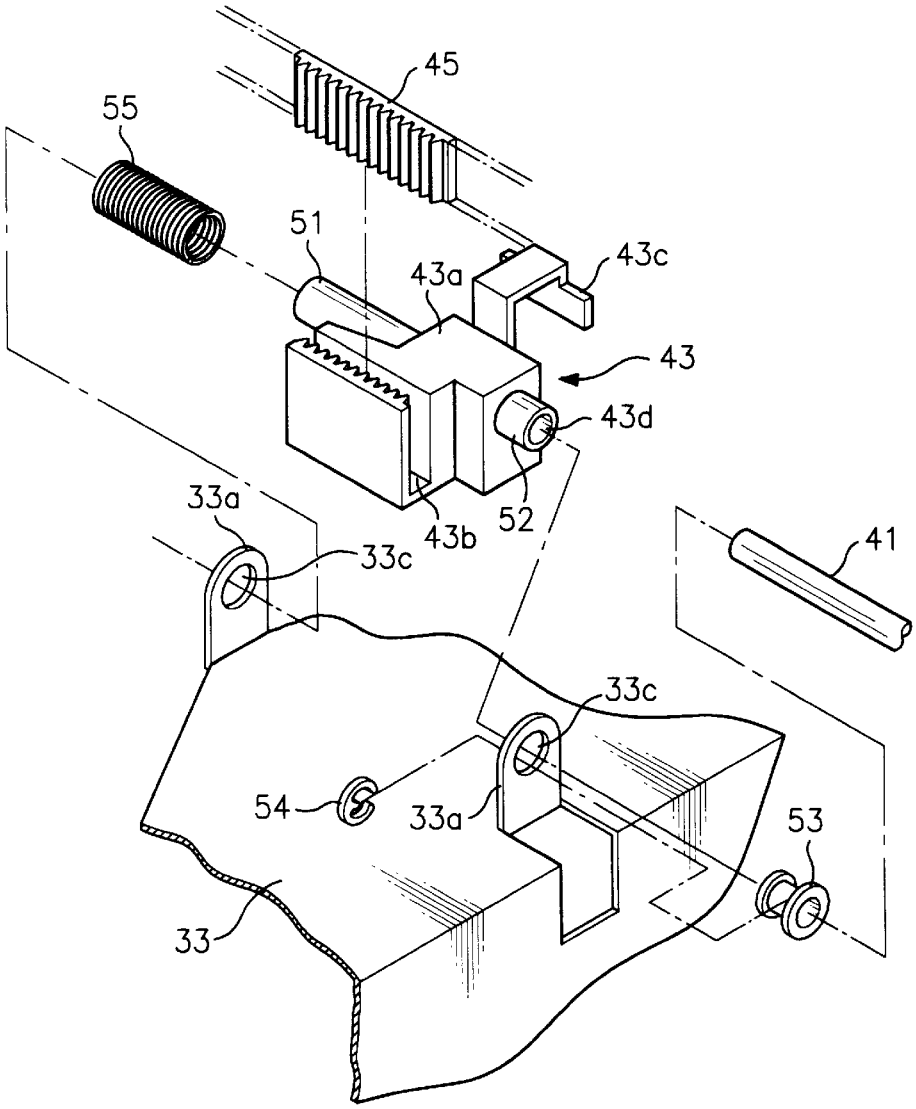
FIG. 7 is a perspective view showing a disassembly of another embodiment of an abutment according to the present invention.
Figure 8:
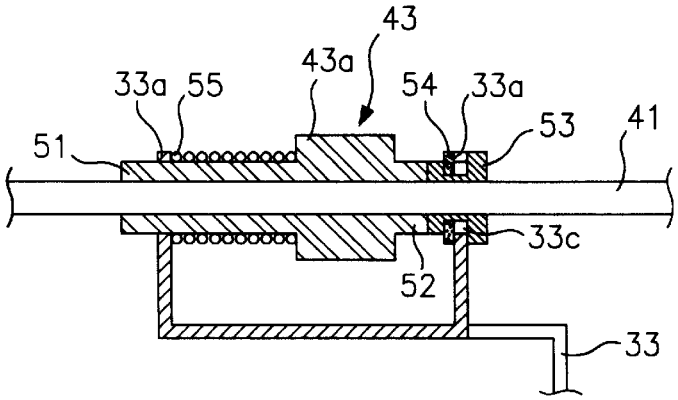
FIG. 8 is a cross-sectional view showing an assembly of the FIG. 7.

FIG. 3 is a side view showing a structure of a sheet post-processing apparatus according to the present invention, FIG. 4 is a perspective view showing a disassembly of an upper tray driving portion of the sheet post-processing apparatus, FIG. 5 is a perspective view showing a disassembly of an abutment of the sheet post-processing apparatus, FIG. 6 is a cross-sectional view showing an assembly of the FIG. 5, FIG. 7 is a perspective view showing a disassembly of another embodiment of an abutment the sheet post-processing apparatus, and FIG. 8 is a cross-sectional view showing an assembly of the FIG. 7.

In FIGS. 3 to 13, the reference numerals are as follows: 30 indicates sheet post-processing apparatus, 31 conveyer, 32 sheet outlet, 33 upper tray, 33*a* first erect portions, 33*b* second erect portion, 33*c* through hole, 34 lower tray, 35 upper motors, 36 lower motor, 37 transmission unit, 38 stapler, 39 discharged sheets, 39*a* a bundle of sheets, 40 base plate, 41 first supporting bar, 42 second supporting bar, 43 abutment, 43*a* body, 43*b* groove, 43*c* protrusion, 43*d* insert hole, 44 belt pulley, 45 belt, 46 sensor, 47 protrusion guide, 48 abutment guide, 51 first pipe, 52 second pipe, 53 hollow member, 55 spring.

As shown in FIG. 3, the sheet post-processing apparatus according to the present invention has a conveyer 31 adjacent to the discharging section on the image forming system, a sheet outlet 32 formed on an end of the conveyer 31, a pair of upper trays 33 adjacent to the sheet outlet 32, a lower tray 34 located under the upper trays 33. Further, the sheet post-processing apparatus has a stapler 38. The stapler 38 is disposed at position not to influence on conveyance of the sheets. The conveyer 31 conveys sheets comming out of the image forming system toward the sheet outlet 32 so that the sheets are discharged through the sheet outlet 32 and are positioned on the upper trays 33. At this time, the stapler 38 performs a stapling operation to the sheets to be discharged from the sheet outlet 32, thereby making a bundle of sheets 39*a*. Thereafter, the bundle of sheets falls from the upper trays 33 and is loaded into the lower tray 34.

In this case, the sheet post-processing apparatus has upper motors 35 for moving the upper trays 33 horizontally (that is, in direction orthoganal to the conveyance direction of the sheets), a transmission unit 37 for transmitting driving force of the upper motors 35 to the upper trays 33. The upper motors 35 can adjust movement distance and movement direction of the upper trays 33 to be horizontally moved. Therefore, when the bundle of sheets 39*a* is accommodated between the upper trays 33, the upper motors 35 move the upper trays 33 so that the bundle of the sheets 39*a* can fall from the upper trays 33.

Further, the sheet post-processing apparatus has a lower motor 36 for vertically moving the lower tray 34, a sensor (not shown) for detecting uppermost end of the lower tray 34 and then providing operation signal to the lower motor 36. The lower motor 36 moves the lower tray 34 downward by thickness of the bundle of sheets 39*a* when the bundle of sheets 39*a* is loaded into the lower tray 34. In this case, if user removes the bundle of sheets 39*a* loaded into the lower tray 34, the lower motor 36 moves the lower tray 34 upward by the removed thickness. Therefore, distance between the upper trays 33 and the lower tray 34 may be always retained within a predetermined range so that the bundle of sheets 39*a* falling from the upper trays 33 is stably loaded into the lower tray 34.

The transmission unit 37, as shown in FIG. 4, has a base plate 40, a first and second supporting bars 41 and 42 disposed at both sides of the base plate 40 in parallel to movement direction of the upper trays 33, a pair of belts 45 connected to each of the upper motors 35. Each of the belts 45 is moved in parallel to the first supporting bar 41 by a plurality of pulleys 44 and is spaced out the first supporting bar 41. In this case, the upper trays 33 are movably joined to the first and second supporting bars 41 and 42.

Further, each of the upper trays 33 includes a pair of first erect portions 33*a* having a through hole 33*c* capable of passing the first supporting bar 41 therethrough, a second erect portion 33*b* having a hole capable of passing the second supporting bar 42 therethrough, two abutments 43 fixed between the two first erect portions 33*a* of each the upper trays 33. Each of the abutments 43 has a body 43*a*. The body 43*a* includes a groove 43*b* for fixing the belt 45, a protrusion 43*c* for indicating a position of the upper tray 33, an insert hole 43*d* for passing the first supporting bar 41. Therefore, when the belt 45 fixed to the groove 43*b* of the abutment 43 is moved by driving force of the upper motors 35, the upper tray 33 fixing the abutment 43 is moved along the first supporting bar 41.

Further, the transmission unit 37 has a pair of sensors 46 disposed at both ends of the first supporting bar 41. The sensors 46 detect positions of the protrusion 43*c*. At this time, positions of the protrusions 43*c* detected by the senosrs 46 are reference points for determining operating time and direction of the upper trays 33.

Preferably, the sheet post-processing apparatus may have a pair of protrusion guides 47 disposed at positions adjacent to the sensors 46 of the base plate 40, and a pair of abutment guides 48 disposed at positions opposite to the protrusion guides 47. Each of the protrusion guide 47 is contacted to lower end of the protrusion 43*c* to prevent that the protrusion 43*c* removes from the detection area of the sensor 46 or collides with the sensor 46. Further, each of the abutment guide 48 is contacted to lower end of the abutment 43 to prevent that the protrusion 43*c* removes from the detection area of the sensor 46.

The abutment 43, as shown in FIG. 5, has first and second pipes 51 and 52 protruded from both sides of the body 43*a* and having a through hole connected to the insert hole 43*d*. External diameter of each the pipe has size capable of being inserted into the through hole 33*c* of the first erect portion 33*a* and internal diameter of each the pipe has size capable of inserting the first supporting bar 41. Further, the sheet post-processing apparatus has a hollow member 53 to be fitted to the through hole 33*c* of the first erect portions 33*a* and an E-ring 54 for fixing position of the hollow member 53. The hollow member 53 has an inner space capable of inserting the first supporting bar 41.

When the abutment 43 is assembled with the first erect portions 33*a* of the upper tray 33, as shown in FIG. 6, the second pipe 52 is inserted into the through hole 33*c* of one erect portion 33*a* so that the abutment 43 is supported by the erect portion, and the first pipe 51 is supported by the hollow member 53 fixed to the other erect portion 33*a*. In this case, mounting positions of the first and second pipes 51 and 52 may be exchanged with each other.

More preferably, as shown in FIG. 7, the sheet post-processing apparatus has a spring 55 disposed at peripheral portion of the first pipe 51. In this case, when the abutment 43 is assembled with the first erect portions 33*a* of the upper tray 33, as shown in FIG. 8, the first pipe 51 is inserted into the through hole 33*c* of one erect portion 33*a* so that the abutment 43 is supported by the erect portion, and the second pipe 51 is supported by the hollow member 53 fixed to the other erect portion 33*a*. At this time, both ends of the spring 55 are respectively supported by the first pipe 51 and the one erect portion 33*a* supporting the first pipe 51. Further, mounting positions of the first and second pipes 51 and 52 may be exchanged with each other. In this case, the spring 55 absorbs shock happening by movement of the upper trays 33 for aligning the sheets or size difference among the sheets owing to difference of manufacturing process. Therefore, the sheet post-processing apparatus according to the present invention can stably align the sheets.

The operation state of the present invention structured as above-mentioned will be explained, referring to the FIGS. 9 to 13.

Figure 9:
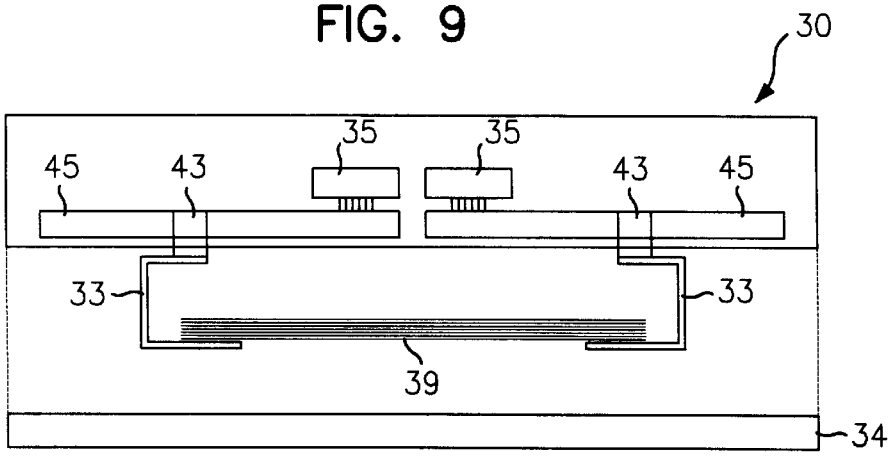
FIG. 9 shows a state accommodating sheets in the sheet post-processing apparatus according to the present invention.
Figure 10:
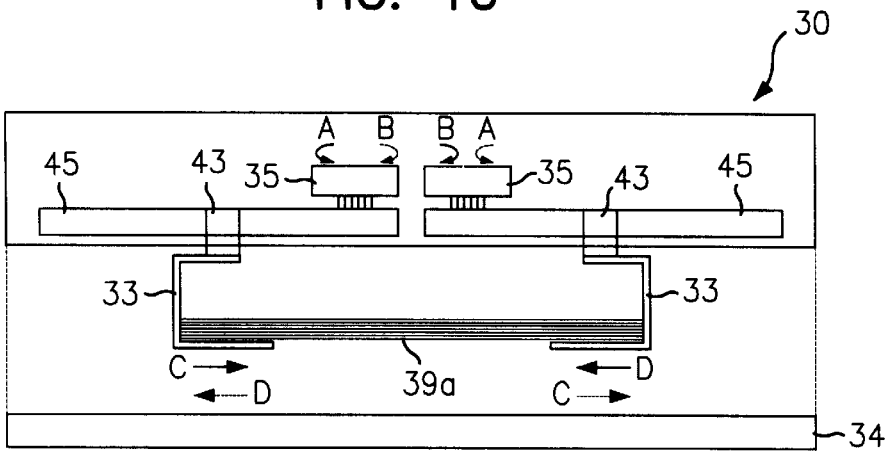
FIG. 10 illustrates a state aligning the sheets in the sheet post-processing apparatus according to the present invention.
Figure 11:
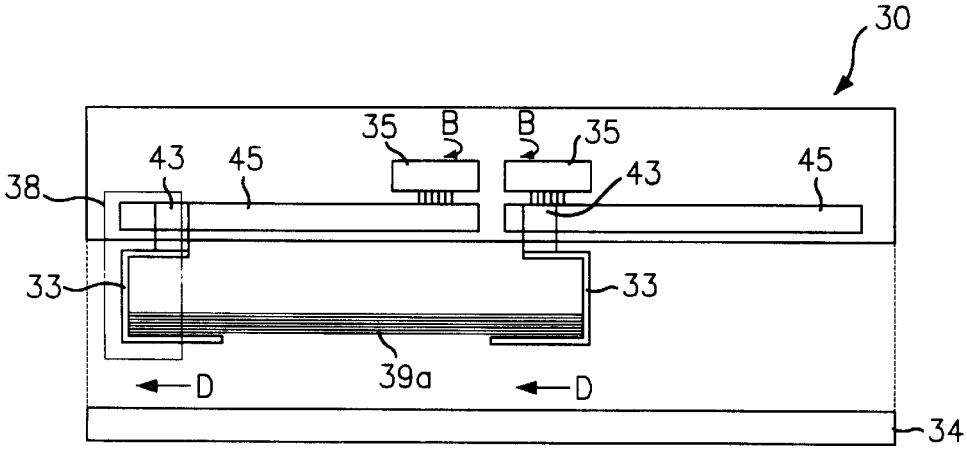
FIG. 11 depicts a state stapling the sheets in the sheet post-processing apparatus according to the present invention.
Figure 12:
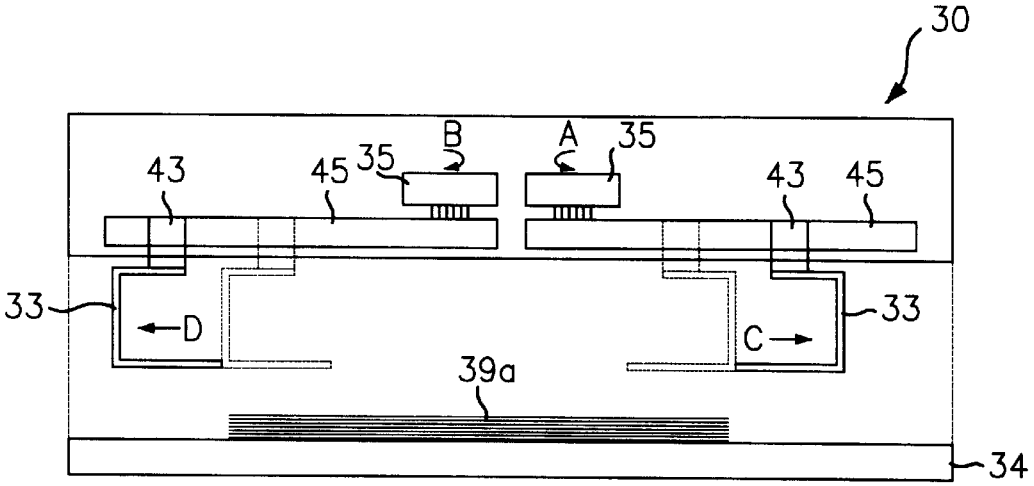
FIG. 12 represents a state loading a bundle of sheets into a lower tray of the sheet post-processing apparatus according to the present invention.
Figure 13:
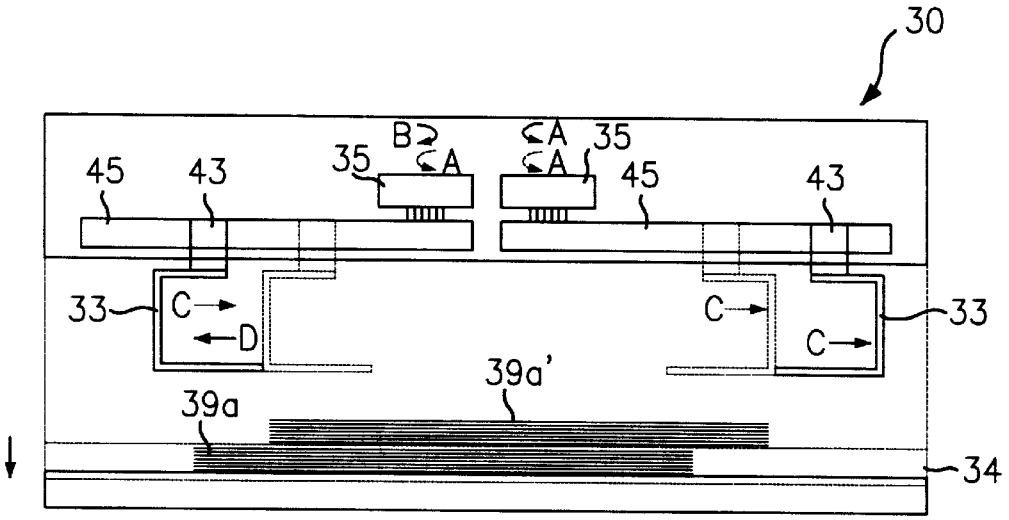
FIG. 13 shows a state loading the next bundle of sheets into the lower tray of the FIG. 12.

FIG. 9 shows a state accommodating sheets in the sheet post-processing apparatus, FIG. 10 illustrates a state aligning the sheets in the sheet post-processing apparatus, FIG. 11 depicts a state stapling the sheets in the sheet post-processing apparatus, FIG. 12 represents a state loading a bundle of sheets into a lower tray of the sheet post-processing apparatus, and FIG. 13 shows a state loading the next bundle of sheets into the lower tray of the FIG. 12.

As shown in FIG. 9, the sheets comming out of the image forming system are discharged through the sheet outlet 32 by the conveyer 31 and are accommodated between the upper trays 33. In this case, the upper trays 33 are spaced out each other by a distance capable of accommodating the discharged sheets 39. That is, if data such as width size of the discharged sheets 39 is transmitted from the image forming system to the sheet post-processing apparatus via an interface, the upper motors 35 are controlled by a CPU(not shown) to move the upper trays 33 in place capable of accommodating the discharged sheets 39.

In the accommodation state, if the sheets 39 are completely accommodated into the upper trays 33, as shown in FIG. 10, the upper motors 35 are repeatedly driven in "A" and "B" directions so that the upper trays 33 reciprocate in "C" and "D" directions and align the sheets 39 accommodated therein. In this case, if sizes of the sheets are different from each other, a shock is happened while the upper trays 33 align the sheets 39, but the shock is absorbed by the spring 55 disposed at the abutments 43. Therefore, when the upper trays 33 align the sheets 39, it may be prevented that the sheets are creased or the apparatus according to the present invention is damaged.

Further, when a post-process such as a stapling is required, as shown in FIG. 11, the upper motors 35 are simultaneously driven in "B" direction. In this case, the upper trays 33 are simultaneously moved in "D" direction so that the sheets 39 are positioned on a side of the stapler 38. At this time, the stapler 38 staples the sheets 39 to make a bundle of sheets 39*a*. Thereafter, the upper trays 33 accommodating the bundle of sheets 39*a* are moved in center portion of the apparatus.

In the both states, for loading the sheets into the lower tray 34, as shown in FIG. 12, the upper motors 35 are driven in opposite directions(that is, "A" and "B" directions) so that the upper trays 33 are moved in opposite directions. That is, the left upper motor is driven in "B" direction to move the left upper tray in "D" direction and the right upper motor is driven in "A" direction to move the right upper tray in "C" direction. Therefore, the distance between the two upper trays 33 is widen so that the sheets can fall down. At this time, the fallen sheets are loaded into the lower tray 34.

Further, when the post-processed bundle of sheets is many, as shown in FIG. 13, the upper motors 35 are simultaneously driven in "A" (or, "B") direction so that the next bundle of sheets 39*a*′accommodated the upper trays 33 is stepped aside from the bundle of sheets 39*a* previously loaded into the lower tray 34 by a predetermined distance. Thereafter, the next bundle of sheets 39*a*′is fallen down by the principle same as description of the FIG. 12. In this case, since staples imbeded into the two bundles of sheets are stepped aside from each other, it may be prevented that a portion of the sheets stacked on the lower tray 34 is higher than the other portions by the stacked staples. Therefore, upper surface of the sheets stacked on the lower tray may be substantially flatted.

Furthermore, the lower tray 34 is moved in up or down by the lower motor 36 driving in positive or negative direction, thereby being spaced out the upper trays 33 so that the bundles of sheets may be stably accommodated.

In the sheet post-processing apparatus according to the present invention, since upper trays move in horizontal direction to make a space capable of accommodating the sheets, the present invention can accommodate variant size sheets.

Further, since the number of parts for organizing the apparatus of the present invention is reduced as compared with that of the prior art, the apparatus can be miniaturized.

Furthermore, since motor generating great driving force is unnecessary, manufacturing cost of the apparatus may be reduced.

It should be understood that the present invention is not limited to the particular embodiment disclosed herein as the best mode contemplated for carrying out the present invention and is not limited to the specific embodiment described in this specification except as defined in the appended claims.

What is claimed is:

1. A sheet post-processing apparatus for post-processing sheets discharged from discharging section of an image forming system, comprising:

a conveying device for conveying said sheets discharged from said image forming system;

a pair of upper trays for accommodating said sheets conveyed by said conveying devices, and being horizontally moved in order to align said sheets accommodated therein and fall down said aligned sheets;

a pair of upper tray driving devices for providing a driving force to said upper trays;

a transmission unit for transmitting said driving force of said upper tray driving device to said upper trays;

a lower tray for loading said sheets fallen from said upper trays; and a lower tray driving device for moving said lower tray in upper and lower directions in order to retain distance between said upper trays and said lower tray in a predetermined range.

2. The apparatus as recited in claim 1, wherein each of said upper tray driving devices includes a motor for providing said driving force to each of said upper trays.

3. The apparatus as recited in claim 2, wherein each of said motors adjusts movement distance and movement direction of said each upper tray to be horizontally moved.

4. The apparatus as recited in claim 3, wherein said transmission unit includes a base plate having a first and a second supporting bars disposed thereon, a plurality of erect portions formed on said each upper tray and having a through hole for passing said supporting bar, a plurality of belts to be moved by said driving force provided from said motors, a plurality of abutments fixed to said upper trays and said belts so that said upper trays are moved together said belts.

5. The apparatus as recited in claim 4, wherein said transmission unit further includes a protrusion formed on a side of each of said abutments, a plurality of sensors disposed at both sides of said first supporting bar and detecting position of said protrusion in order to detect positions of said abutments.

6. The apparatus as recited in claim 5, wherein said transmission unit further includes a pair of protrusion guides disposed at both sides of said first supporting bar, a pair of abutment guides disposed at positions opposite to said protrusion guides, and said protrusion guides and said abutment guides prevent that said protrusions and said abutments remove from a detection area of said sensors.

7. The apparatus as recited in claim 5, wherein each of said abutment includes a body having an insert hole for passing said first supporting bar, a pair of pipes elongated from both sides of said body, and wherein, said pipes have an external diameter capable of being inserted into said through hole of said erect portion and an internal diameter capable of passing said first supporting bar.

8. The apparatus as recited in claim 7, wherein said transmission unit further includes a hollow member inserted into said through hole of one of said erect portions in order to support one of said pipes, a join member for fixing position of said hollow member inserted into said through hole.

9. The apparatus as recited in claim 8, wherein said transmission unit further includes a spring surrounding peripheral portion of the other pipe without being supported by said hollow member.

* * * * *